US006586877B1

(12) United States Patent
Suyama et al.

(10) Patent No.: US 6,586,877 B1
(45) Date of Patent: Jul. 1, 2003

(54) ELECTRON TUBE

(75) Inventors: Motohiro Suyama, Hamamatsu (JP); Akihiro Kageyama, Hamamatsu (JP); Masaharu Muramatsu, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 0 days.

(21) Appl. No.: 09/889,605

(22) PCT Filed: Jan. 21, 1999

(86) PCT No.: PCT/JP99/00212

§ 371 (c)(1),
(2), (4) Date: Jul. 19, 2001

(87) PCT Pub. No.: WO00/44026

PCT Pub. Date: Jul. 27, 2000

(51) Int. Cl.[7] ..... H01J 40/00

(52) U.S. Cl. ..... 313/523; 313/530; 313/542; 313/544

(58) Field of Search ..... 313/523, 527, 313/528, 530, 532, 541, 542, 544

(56) References Cited

U.S. PATENT DOCUMENTS 4,178,529 A 12/1979 Kennedy

FOREIGN PATENT DOCUMENTS

| | | |
|---|---|---|
| FR | 2 629 946 A1 | 10/1989 |
| JP | A 1-216546 | 8/1989 |
| JP | A 3-163872 | 7/1991 |
| JP | A 6-29506 | 2/1994 |
| JP | A 6-243795 | 9/1994 |
| JP | A 6-318447 | 11/1994 |
| JP | A 6-334158 | 12/1994 |
| JP | A 7-36411 | 4/1995 |
| JP | B2 7-95434 | 10/1995 |
| JP | B2 2821062 | 8/1998 |
| JP | A 11-40086 | 2/1999 |

*Primary Examiner*—Vip Patel
(74) *Attorney, Agent, or Firm*—Oliff & Berridge, PLC

(57) ABSTRACT

In an electron tube 1, a space S between a periphery part 15*b* of a semiconductor device 15 and a stem 11 is filled with an insulating resin 20. The insulating resin 20 functions as a reinforcing member while the electron tube 1 is assembled under high-temperature condition, thereby preventing a bump 16 from coming off a bump connection portion 19. Since the space S is only partly closed by the resin 20, the space between the semiconductor device 15 and the stem 11 is ensured a ventilability. That is, no air reservoir is formed between an electron incidence part 15*a* at the center of the semiconductor device 15 and the surface C of the stem 11, whereby air expanding at high temperature does not damage the electron incidence part 15*a* of the back-illuminated semiconductor device 15.

11 Claims, 14 Drawing Sheets

ELECTRON TUBE

TECHNICAL FIELD

The present invention relates to a highly sensitive electron tube for quantitatively measuring an extremely weak light.

BACKGROUND ART

This field of technology is described in Japanese Patent Publication No. HEI-7-95434, for example. An electron tube described in this publication has a package, in which a charge coupled device (CCD) of a back-illuminated type is provided. In this type of electron tube, electron emitted from a photocathode in response to an incidence of light is directed into a back side of a device formation surface to detect a signal. This electron tube is widely used because of its high sensitivity and its high imaging quality.

An imaging device employing a back-illuminated type semiconductor device is described in Japanese unexamined patent application publication No. HEI-6-29506. The semiconductor device is fixed on a substrate whose thermal expansion coefficient is equal to that of the semiconductor device. A plurality of metal bumps are formed on the semiconductor device, each bump being connected to a metal wiring formed on the substrate (silicon wafer). The space between the semiconductor device and the substrate is filled with a nonconductive resin to prevent silicon etchant from entering therein. Since the space is filled prior to thinning of the semiconductor device, the resin has to not include alkali metal, has to have a suitable contraction stress during curing to maintain sufficient contact of the bonding part of the bumps, and has to be able to withstand heat up to about 150° C. during die-bonding and wire-bonding.

However, conventional electron tubes and imaging devices have the following problems due to the construction described above.

In the electron tube described in Japanese patent publication No. HEI-7-95434, the semiconductor device is fixed to the stem by bonding metal pads to contacts. However, the metal pads have a tendency to slip off the contacts to lose a sufficient connection when the electron tube is assembled under a high-temperature environment.

In the imaging device described in Japanese unexamined patent application publication No. HEI-6-29506, the semiconductor device is thinned with etchant after the semiconductor device is fixed to the substrate. Accordingly, the space between the semiconductor device and the substrate is completely filled with resin in order to prevent any etchant from entering therein. Since the resin is attached directly on the electron incidence part of the semiconductor device, stress is generated in the electron incidence part when the resin cures or hardens. The electron incidence part runs the risk of becoming deformed, resulting in poor images, or in some cases broken.

In view of the foregoing, it is an object of the present invention to solve the above-described problems and to provide an electron tube which is capable of avoiding poor connections that can occur during the assembly process, as well as deformation or damage to the.semiconductor device that can also occur during this process.

DISCLOSURE OF THE INVENTION

These objects and others will be attained by an electron tube, comprising: a side tube; a faceplate provided at one end of the side tube and having a photocathode that emits electrons in response to incident light; a stem provided at the other end of the side tube, the stem and the faceplate defining a vacuum region, the stem having a bump connection portion on its surface; and a semiconductor device fixed to the stem at its vacuum side, the semiconductor device having a front surface positioned on the stem side and a back surface positioned on the faceplate side, the semiconductor device including an electron incidence part, for receiving electrons emitted from the photocathode, and a periphery part provided at an outer periphery of the electron incidence part, the electron incidence part having a thin plate shape whose thickness is smaller than that of the periphery part, the periphery part having a bump which protrudes from the front surface thereof the bump being fixed to the bump connection portion, the bump forming a space between the front surface of the semiconductor device and the surface of the stem, a filling material with insulation property being filled partially in the space at the periphery part, thereby partially closing the space at the periphery part.

Hence, the electron tube of the present invention includes: a side tube; a faceplate provided at one end of the side tube and having a photocathode that emits electrons in response to incident light; a stem provided at the other end of the side tube, the stem and the faceplate defining a vacuum region; and a semiconductor device fixed to the evacuated side of the stem and having an electron incidence part for receiving electrons emitted from the photocathode. The semiconductor device is configured as a back-illuminated type semiconductor device. That is, the semiconductor device has a front surface positioned on the stem side and a back surface positioned on the faceplate side. The semiconductor device has a plate-shaped electron incidence part that is formed thinner than the periphery part which is formed around the electron incidence part. A bump is formed to protrude from the front surface of the periphery part. The bump is fixed to a bump connection portion provided on the surface of the stem. The bump forms a space between the front surface of the semiconductor device and the surface of the stem. The space at the periphery part is partially filled with a filling material with insulating properties. Accordingly, the space at the periphery part is partially closed with the filling material having insulating properties.

Accordingly, in the electron tube of the present invention, insulating filling material is filled partially in the space between the periphery part of the semiconductor device and the stem, while the bump formed on the semiconductor device is connected to the bump connection portion provided on the surface of the stem. Hence, the filling material functions as a reinforcing member to prevent the bump from separating from the bump connection portion even when the electron tube is assembled under a high-temperature environment.

The space defined at the periphery of the semiconductor device is filled with insulating filling material, while the space defined at the electron incidence part is not filled with the insulating filling material. Accordingly, there is no danger of the electron incidence part becoming deformed or damaged due to stress generated when the insulating filling material is hardened.

Further, ventilation between the semiconductor device and the stem is ensured because the space between the semiconductor device and stem is only partially closed by the filling material. If the entire circumference of the periphery part of the semiconductor device were completely closed by the filling material, an air reservoir would be formed between the electron incidence part and the surface of the stem. During the process of assembling the electron tube in a vacuum, this air would expand and could cause damage to the electron incidence part which is formed as a thin plate on the back-illuminated semiconductor device. Contrarily, the present invention enables air to flow between the semiconductor device and the stem, ensuring that air can be evacuated in the vacuum environment when the electron tube is assembled.

Thus, according to the present invention, the bump protruding from the front surface of the periphery part of the semiconductor device is fixed to the bump connection portion which is provided on the surface of the stem. This bump forms the space between the front surface of the semiconductor device and the surface of the stem. The space along the periphery part of the semiconductor device is partially filled with a filling material with insulation properties. Accordingly, the space is closed only partially with the insulating filling material. As a result, it is possible to prevent poor bump connection that can possibly arise when the electron tube is assembled and to prevent damage to the semiconductor device that can occur during the same process.

The filling material with insulation property may preferably be filled in the space at the periphery part of the semiconductor device except for at least one position along the entire circumference of the periphery part, thereby allowing the space at the periphery part to be filled with the filling material with insulation property except for the at least one position.

For example, the filling material with insulation property may preferably be filled in the space at at least one position along the entire circumference of the periphery part of the semiconductor device, with a ventilating region being formed in at least one position along the entire circumference of the periphery part of the semiconductor device to provide fluid communication between the space and the vacuum region. With this construction, it is possible to avoid, by the insulating filling material, poor bump connection which can be caused when the electron tube is assembled, and to eliminate damage to the semiconductor device that can occur during the same process by ensuring ventilation through the ventilating region.

The filling material may have an electrically insulating material. The filling material may have a melting characteristic, but when heated, the filling material may be hardened and contract at an appropriate contraction stress to adhere to a surrounding material. An insulating resin is preferable as the insulating filling material. However, water glass or low-melting glass can be used.

Additionally, the stem may preferably have a supporting substrate on its surface, the supporting substrate being formed of the same silicon material as a base material of the semiconductor device, the bump connection portion being provided on the supporting substrate. With this configuration, the thermal expansion coefficient of the supporting substrate which has the bump connection portion can be.made approximately equal to that of the semiconductor device which has the bump. Therefore, the bump will not separate from the bump connection portion during the baking (heating) process in the electron tube manufacturing process, thereby maintaining a better connection state.

The bump may preferably be made of material that includes gold as a primary component. When the bump is made of material whose primary component is gold, the bump does not melt during the baking process in the manufacturing process. Further, because the insulating material, which is filled partially in the space between the periphery part of the semiconductor device and the stem, serves as a reinforcing material, the insulating material can prevent breakage in the bump, whose main component is gold, during the baking process.

The stem may have, at its surface, a channel for controlling the partial filling of the filling material with insulating property into the space at the periphery part. With this configuration, it is possible to allow an excess insulating filling material to flow into the channel when the insulating filling material is introduced from outside the periphery part into the space between the periphery part of the semiconductor device and the stem. Therefore, it is possible to prevent the insulating filling material from being attached to the electron incidence part of the semiconductor device, eliminating the possibility of the electron incidence part becoming damaged when the filling material cures or hardens. Accordingly, the filling of the insulating material can be attained appropriately without precisely controlling the amount of the insulating filling material. Especially, when the space between the semiconductor device and the stem is extremely narrow, the capillary effect can be used to force the insulating filling material to flow into the space. The excess insulating filling material automatically flows into the channel. Accordingly, control of the flow can be made easy and efficient.

For example, the channel may preferably have a width that allows the channel to span across a border between the periphery part and the electron incidence part. When the channel, whose width has a value to allow the channel to span across the border between the periphery part and the electron incident part, is formed on the surface of the stem, in order to fill the insulating filling material into the space between the periphery part of the semiconductor device and the stem, it is possible to introduce the filling material from outside the periphery part while letting the excess filling material to flow into the channel. It is therefore possible to easily prevent the filling material from attaching the electron incidence part. Especially when the space is extremely narrow, the capillary effect can be employed to draw the filling material into the space, making the process for introducing the filling material easy and efficient. When the width of the channel is set at a size to span across the border between the periphery part and the electron incidence part, several channels can be formed individually in correspondence with several regions to be filled with the filling material.

The channel may preferably be formed at a region that faces the periphery part only. When the channel is formed on the surface of the stem to confront only the periphery part, in order to fill the insulating filling material in the space between the periphery part of the semiconductor device and the stem, it is possible to introduce the filling material into the space from outside the periphery part while allowing an excess filling material to flow into the channel. It is therefore possible to easily prevent the filling material from attaching the electron incidence part. Especially when the space is extremely narrow, the capillary effect can be employed to draw the filling material into the space, making the process for introducing the filling material easy and efficient. In addition, the initial objective can be attained simply by forming the channel to correspond only to the periphery part.

The channel may preferably have a width that allows the channel to span across one side portion of the periphery part and the other opposing side portion of the periphery part. When the channel, whose width can allow the channel to span across one side portion of the periphery part and the other opposing side portion of the periphery part, is formed on the surface of the stem, in order to fill the insulating filling material in the space between the periphery part of the semiconductor device and the stem, it is possible to introduce the filling material into the space from outside the periphery part while allowing an excess filling material to flow into the channel. It is therefore possible to easily prevent the filling material from attaching the electron incidence part. Especially when the space is extremely narrow, the capillary effect can be employed to draw the filling material into the space, making the process for introducing the filling material easy and efficient. In addition, when the width of the channel is set to span across one side portion of the periphery part and the other opposing side portion in this way, it is possible to form a channel that corresponds to the size and shape of the electron incidence part of the semiconductor device.

The space formed by the bump may preferably have, at the periphery part, a height small enough to allow the filling material with insulation property to generate a capillary effect.when the filling material is drawn into the periphery part, the channel having a depth of an amount that is capable of stopping the filling material that flows due to the capillary effect. With this construction, when the filling material flowing according to the capillary effect reaches the edge of the channel, the filling material does not enter the channel but collects along the edge due to surface tension in the material. Therefore, the filling material can be easily drawn into the space and, at the same time, can be easily and effectively prevented from attaching the electron incidence part of the semiconductor device.

BEST MODE FOR CARRYING OUT THE INVENTION

An electron tube according to preferred embodiments of the present invention will be described while referring to FIGS. 1–12.

First, an electron tube according to a first embodiment will be described with reference to FIGS. 1–8.

Figure 1:
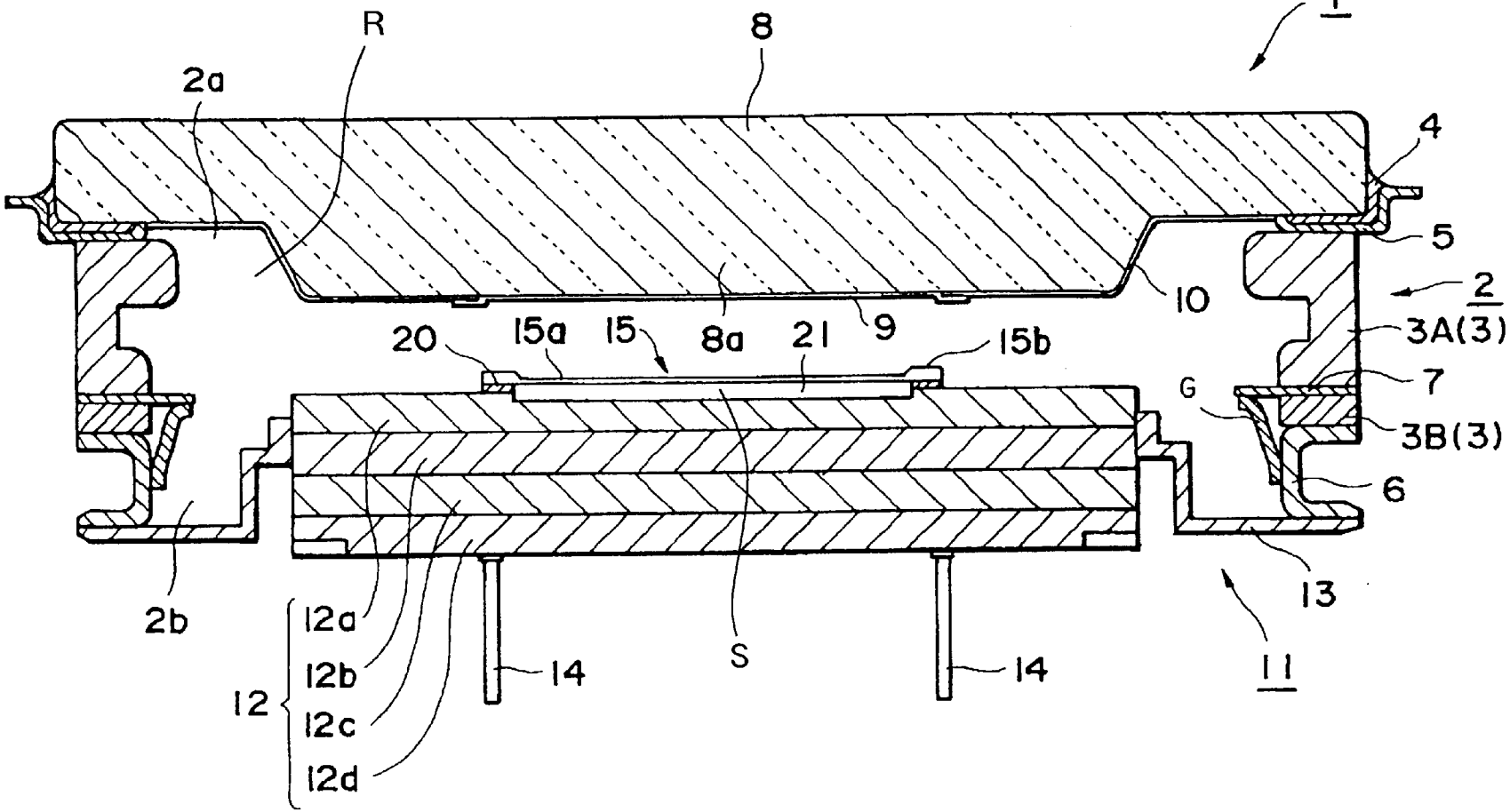
FIG. 1 is a cross-sectional view showing an electron tube according to a first embodiment of the present invention.

FIG. 1 is a cross-sectional view showing an electron tube 1 according to the first embodiment of the present invention. The electron tube 1 is of a proximity focusing type in which a photocathode is positioned near to a semiconductor device. The electron tube 1 includes a side tube 2 having two open ends 2*a* and 2*b*. A substantially. disc-shaped faceplate 8 is bonded to the open end 2*a*, and a similarly substantially disc-shaped stem 11 is bonded to the open end 2*b*, to provide a sealed structure in which a vacuum region R is provided. A photocathode 9 is formed over the surface of the faceplate 8 on the vacuum region R side, while a semiconductor device (CCD device) 15 is fixed to the stem 11 on the vacuum region R side, thereby achieving the functions of an electron tube.

The side tube 2 has a cylindrical shape with an external diameter of approximately 43 mm, for example. The side tube 2 has a ring-shaped bulb 3 which is made of an electrically insulating material, such as ceramic. The bulb 3 includes a first bulb 3A, a second bulb 3B, and a flange portion 7. The flange portion 7 is made of Koval metal, and is interposed between the first and second bulbs 3A and 3B. The three parts are constructed integrally into the bulb 3 through brazing. An annular cathode electrode 5 is provided in the opening on the first bulb 3A side (the first open end 2*a*), while an annular welding electrode 6 is provided in the opening on the second bulb 3B side (the second open end 2*b*). The cathode electrode 5 and the welding electrode 6 are brazed to the bulb 3 to form an integral unit. The cathode electrode 5 is in a gutter shape for collecting indium material 4. The indium material 4 serves as an adhesive agent for bonding the side tube 2 to the faceplate 8 and as a sealing member for creating the vacuum region R. The cathode electrode 5 can supply an electric voltage to be applied to the photocathode 9.

The faceplate 8 made of Koval glass is disposed over the first open end 2*a*. The faceplate 8 has a protruded portion 8*a* at its center portion. The faceplate 8 is fixed and sealed to the cathode electrode 5 via the indium material 4. A photocathode 9 is formed on the inner surface of the faceplate 8. The photocathode 9 is for emitting electrons into the vacuum region in response to incidence of light. A photocathode electrode 10 is formed on the faceplate 8 around the photocathode 9. The photocathode electrode 10 is made of a chrome thin film, and is deposited onto the faceplate 8. The photocathode electrode 10 electrically connects the photocathode 9 with the indium material 4.

The faceplate 8 and the stem 11, which is fixed over the second open end 2*b* of the side tube 2, define the vacuum region R. The stem 11 includes: a four-layered base plate 12 formed of ceramic; and a metal flange 13 which is fixed to the base plate 12 by brazing. The back-illuminated type semiconductor device 15, having a silicon substrate as its base material, is fixed to a surface C (see FIG. 2) of a base plate 12*a*, which is the uppermost layer of the base plate 12. As shown in FIG. 1, a plurality of stem pins 14 are fixed to a base plate 12*d*, which is the lowermost layer of the base plate 12, for applying drive signals to the semiconductor device 15 from an external device and for outputting signals outputted from the semiconductor device 15 to an external device. Internal wirings or leads (not shown) are provided within the base plate 12 for electrically connecting the semiconductor device 15 with the stem pins 14. The internal wirings transmit drive signals, applied to the stem pins 14, to the semiconductor device 15, and transmit signals, outputted from the semiconductor device 15, to the stem pins 14. The side tube 2 and the stem 11 are formed as an integral unit by arc welding the metal flange 13 and the welding electrode 6 together. A getter G is fixed to the inner wall of the side tube 2. The getter G is for absorbing residual gas in the electron tube. This getter G is connected between the welding electrode 6 and the flange portion 7.

Figure 2:
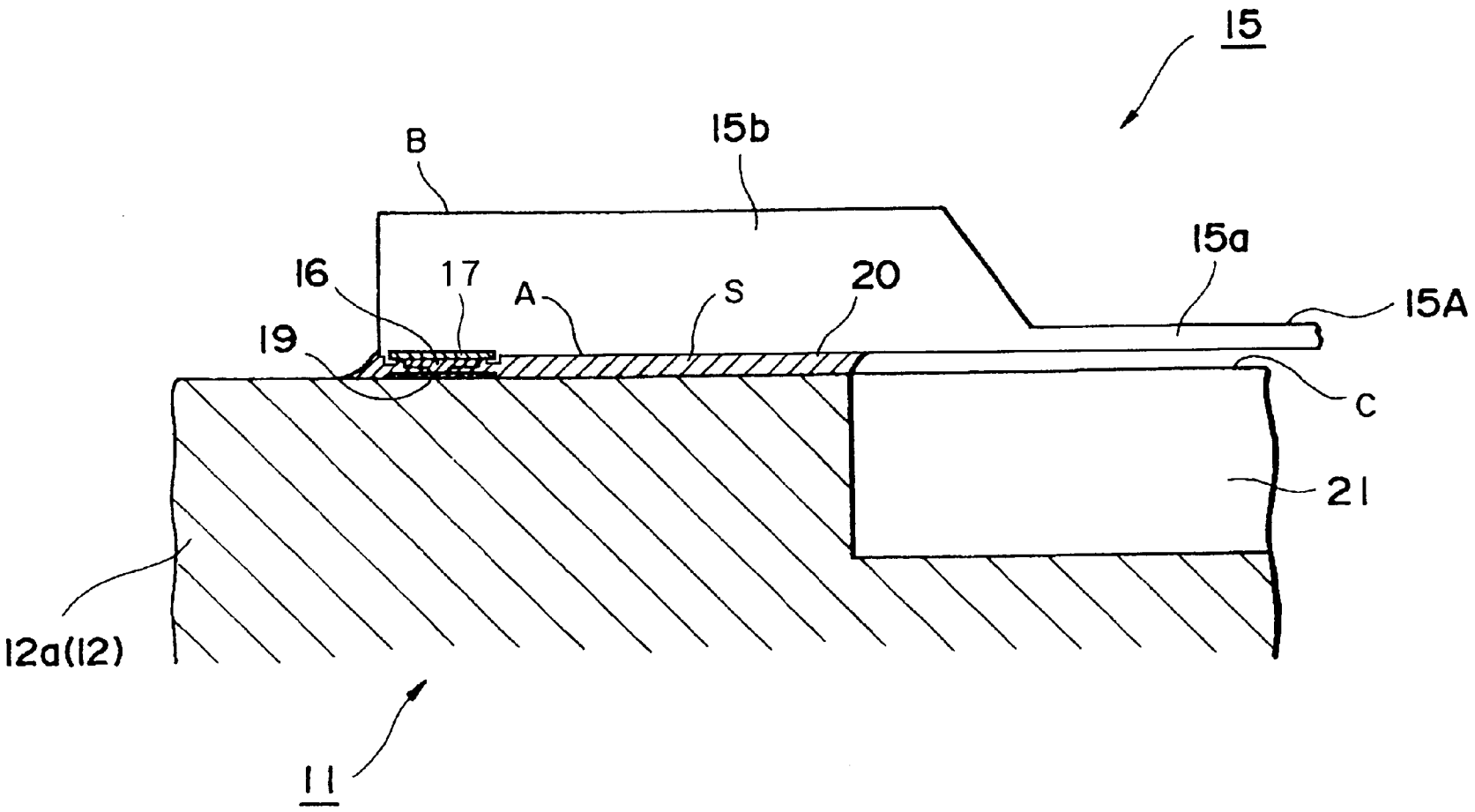
FIG. 2 is an enlarged cross-sectional view showing a portion where the semiconductor device is bonded to the stem of the electron tube according to the first embodiment.

As shown in FIGS. 1 and 2, the semiconductor device 15 has an electron incidence part 15*a* at its central part. The semiconductor device 15 is disposed near the photocathode 9 at a distance of approximately 1 millimeter. Electrons emitted from the photocathode 9 fall incident on the electron incidence part 15*a*. The semiconductor device 15 is configured as a back-illuminated type semiconductor device, and a front surface A (device-formed surface) of the semiconductor device 15 is positioned on the base plate 12 (stem 11) side, while a back surface B of the semiconductor device 15 is positioned on the faceplate 8 side. The electron incidence part 15*a* is formed thinner than a rectangular periphery part 15*b* (see FIGS. 3 and 8), which is provided around the electron incidence part 15*a*, in order to achieve the back-illuminated function of the semiconductor device 15. A chemical etching process is employed to form the electron incidence part 15*a* into a thin plate of approximately 20 $\mu$m thickness, while remaining the periphery part 15*b*.

FIG. 2 is a cross-sectional view showing the portion where the semiconductor device 15 is bonded to the uppermost base plate layer 12*a*. As will be described later, a plurality of bumps 16 are provided via bonding pads 17 on the front surface A of the periphery part 15*b*. The bumps 16 serve as electrodes. A plurality of bump connection portions 19 are formed on the upper surface C of the base plate 12*a* at positions where the bump connection portions 19 can connect with the bumps 16. Thus, the semiconductor device 15 and the base plate 12*a* are mechanically and electrically connected via the bonding pads 17, the bumps 16, and the bump connection portions 19. A conductive resin 18 (see FIG. 7) is provided around each bump 16 to prevent electrical disconnections of the bump 16. The area surrounding the conductive resin 18 is filled with an insulating resin 20 to reinforce the connection between the semiconductor device 15 and the base plate 12*a*.

The internal wirings (not shown) are provided inside the base plate 12. The internal wirings are for electrically connecting each bump connection portion 19, which is connected to the corresponding bump 16, to the corresponding stem pin 14 (see FIG. 1). The positions of the respective bump connection portions 19 on the surface C of the base plate 12*a* are offset from the positions of the corresponding stem pins 14 on the base plate 12*d*. Accordingly, internal wirings (not shown) provided in the intermediate base plates 12*b* and 12*c*, which serve as the second and third layers of the base plate 12, are connected with each other, while being offset at a prescribed pitch. With this construction, each bump connection portion 19 on the surface of the base plate 12*a* is connected appropriately to the corresponding stem pin 14. A drive signal applied to one stem pin 14 is properly guided to the corresponding bump 16 via the corresponding bump connection portion 19. Signals outputted from the semiconductor device 15 to one bump 16 are properly guided to the corresponding stem pin 14 via the corresponding bump connection portion 19.

Next, the structure of the semiconductor device 15 will be described in greater detail.

Figure 3:
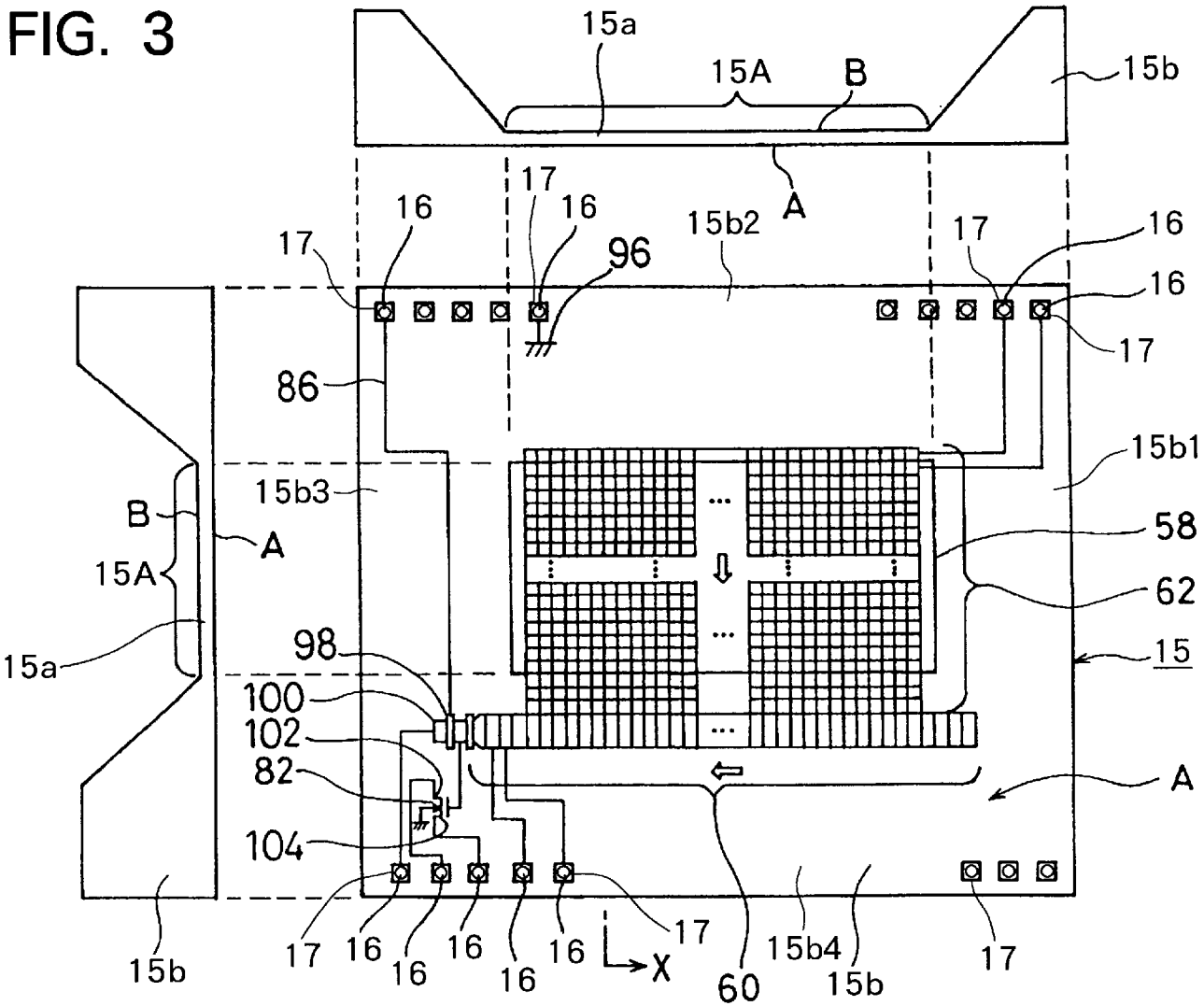
FIG. 3 is plan and side views showing the semiconductor device used in the electron tube of the first embodiment.

As shown in FIG. 3, a CCD is formed on the front surface A side of the semiconductor device 15. The semiconductor device 15 is formed into a thin plate by chemically etching the silicon substrate on the back surface B side of the semiconductor device 15 while remaining the periphery part 15*b*.

More specifically, an electron incidence part 15A is formed in the center portion of the back surface B as shown in FIG. 3. A charge horizontal transfer portion 60 and a charge vertical transfer portion 62 are formed on the front surface A. The charge horizontal transfer portion 60 and the charge vertical transfer portion 62 are for reading charge incident on the electron incidence part 15A and for transferring the charge to an external circuit. In FIG. 3, 82 designates an FET portion, 86 designates a conductive aluminum wire or lead, 96 designates a connection portion connected to a substrate (64) of the CCD, 98 designates a reset gate terminal, 100 designates a reset drain terminal, 102 designates an output drain terminal, and 104 designates an output source terminal. A description of these parts are omitted because the parts are individually well known in the art.

Figure 4:
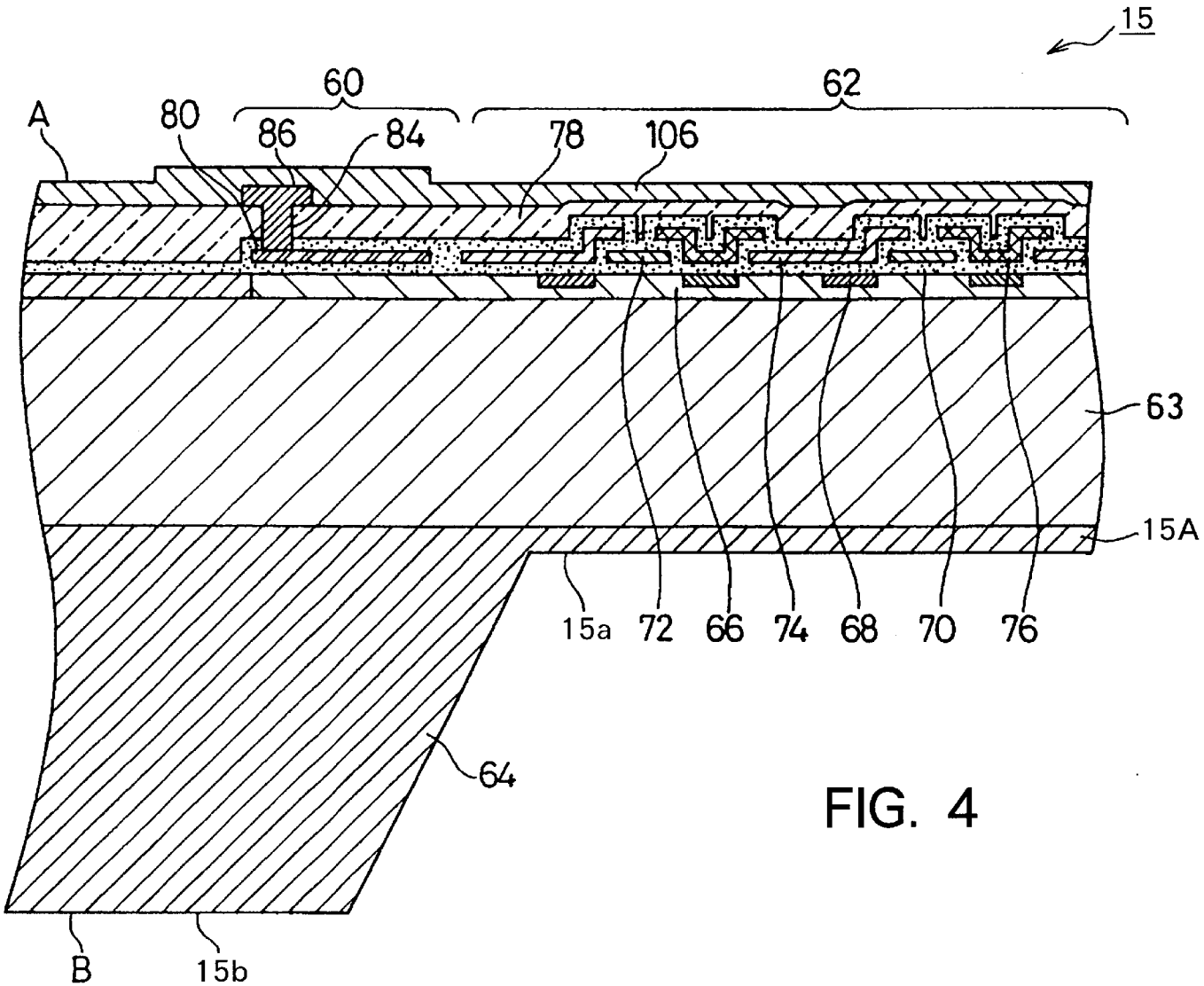
FIG. 4 is a cross-sectional view showing the semiconductor device used in the electron tube of the first embodiment.

FIG. 4 shows a cross-section of the semiconductor device 15 taken along the line X in FIG. 3. A semiconductor substrate 64, which is the base material making up the semiconductor device 15, is formed of a P-type or an N-type silicon. The central section of the semiconductor wafer 64 is formed thinner than the periphery part. An epitaxial layer 63 having a different impurity concentration than that is of the semiconductor wafer 64 is formed on the front surface A side of the semiconductor wafer 64. The CCD of the semiconductor device 15 is formed on the epitaxial layer 63 side. More specifically, a buried layer 66, which provides the opposite conductive property against the semiconductor substrate 64, is formed on the epitaxial layer 63. Barrier regions 68 having an impurity concentration different from that of the buried layer 66 are formed by introducing impurities at prescribed positions in the buried layer 66. Storage electrode layers 72, transfer electrode layers 74, and barrier electrode layers 76 are formed as partly overlapping with one another with an $SiO_2$ layer 70 interposing between the layers.

On the front surface A side of the semiconductor device 15, a PSG film 78 (leveling film) is formed over the entire front surface A of the semiconductor device 15 to form a level surface on the semiconductor device 15. The PSG film 78 (leveling film) is made of phosphosilicate glass (hereinafter referred to as PSG). Contact holes 84 are formed in the PSG layer 78 at positions above terminals, such as electrodes 80 of the charge horizontal transfer portion 60 and the charge vertical transfer portion 62 and the FET portions 82. These terminals are electrically connected to the aluminum wires 86 which are formed on the PSG layer 78 through the contact holes 84. An SiN film 106 (thin film) described later is formed over the top of the PSG layer 78.

Figure 5:
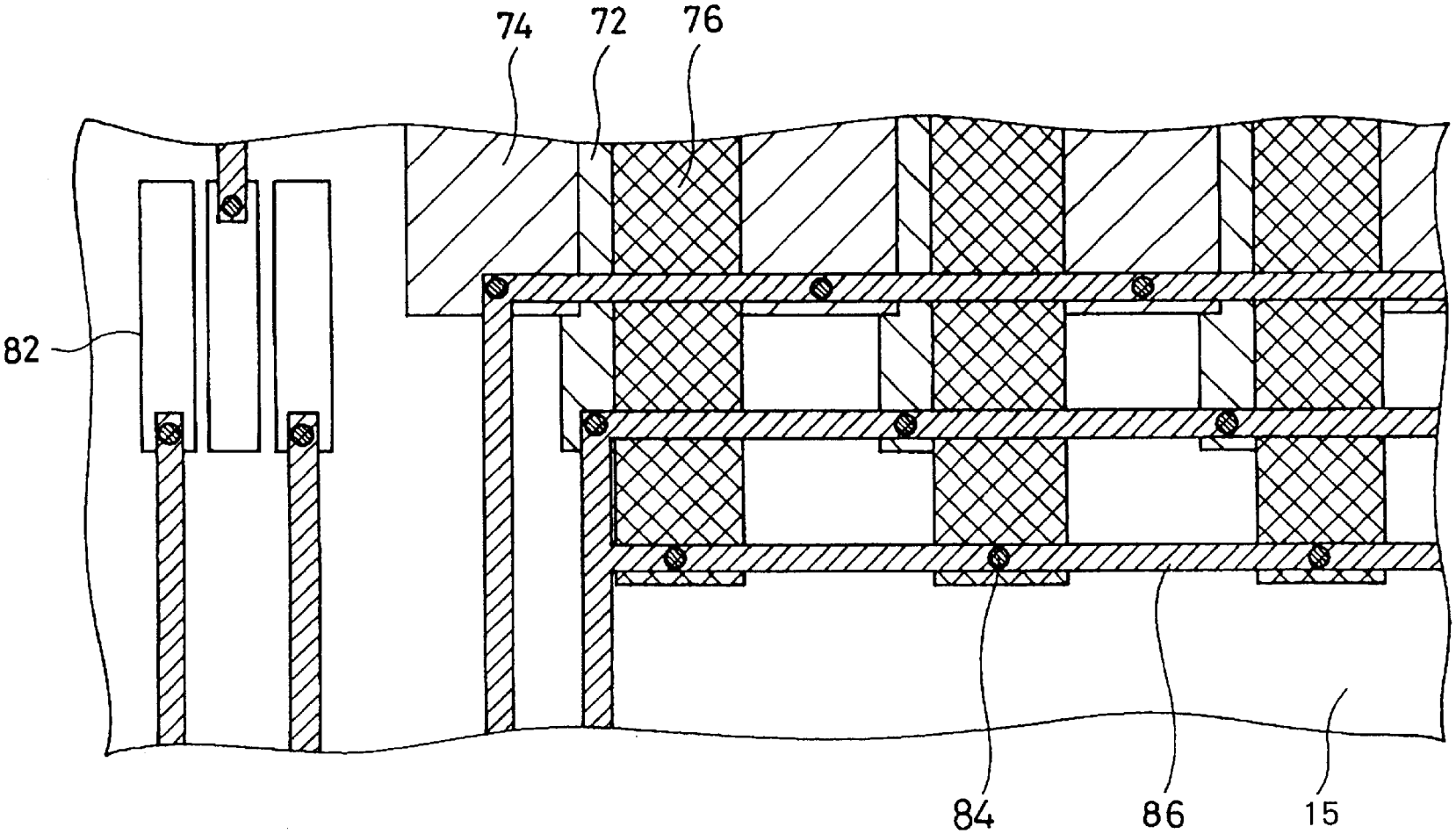
FIG. 5 is an enlarged view of aluminum wirings provided in the semiconductor device used in the electron tube of the first embodiment.

FIG. 5 schematically shows the configuration of the aluminum wires 86 and the contact holes 84 in the charge horizontal transfer portion 60. The aluminum wires 86 are formed to cover the contact holes 84, thereby establishing electrical connection between the terminals of the charge transfer portion and the aluminum wires 86. Here, terminals refer to the locations at which the aluminum wires 86 passing through the contact holes 84 connect with portions of the charge horizontal transfer portion 60 and the charge vertical transfer portion 62.

Figure 6:
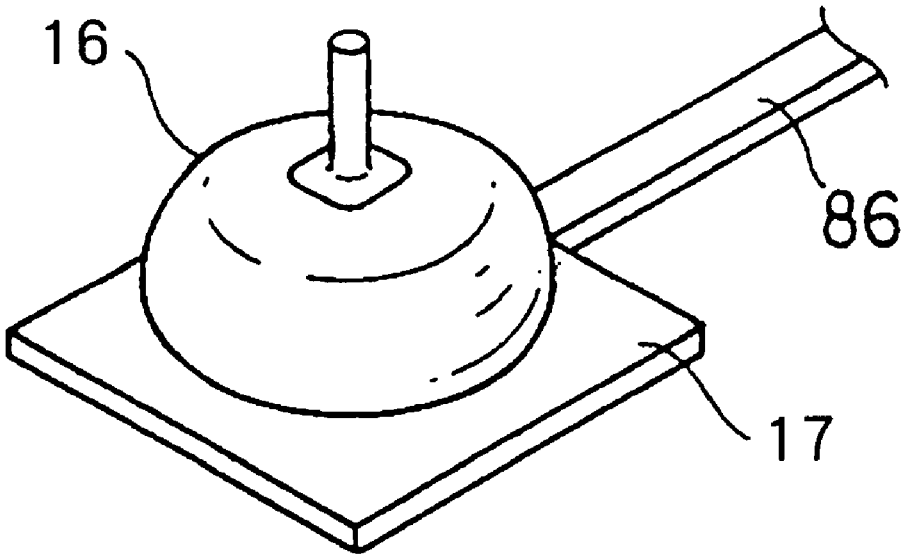
FIG. 6 is an enlarged perspective view showing a bonding pad and a bump used in the electron tube of the first embodiment.

As shown in FIG. 3, the aluminum wires 86 formed on the PSG layer 78 are electrically connected to the charge horizontal transfer portion 60, the charge vertical transfer portion 62, the substrate connection portion 96, the reset gate terminal 98, the reset drain terminal 100, the output drain terminal 102, the output source terminal 104, and the like. The aluminum wires 86 are provided with a plurality of bumps 16 (electrodes) at a plurality of locations on the periphery part 15*b*. The bumps 16 are connected to the bump connection portions 19 on the base plate 12*a*. More specifically, the rectangular peripheral part 15*a* has four side portions 15*b*1, 15*b*2, 15*b*3, and 15*b*4, and the aluminum wires 86 have a plurality of end portions on two of the four side portions 15*b*1, 15*b*2, 15*b*3, and 15*b*4, that is, on the two opposing side portions 15*b*2 and 15*b*4. As shown in FIG. 6, at each end portion, the aluminum wire 86 has a bonding pad 17 which has a larger area than the aluminum wire 86. A bump protrusion 16 made of gold (Au) is formed by Au deposition on each bonding pad 17.

Figure 7:
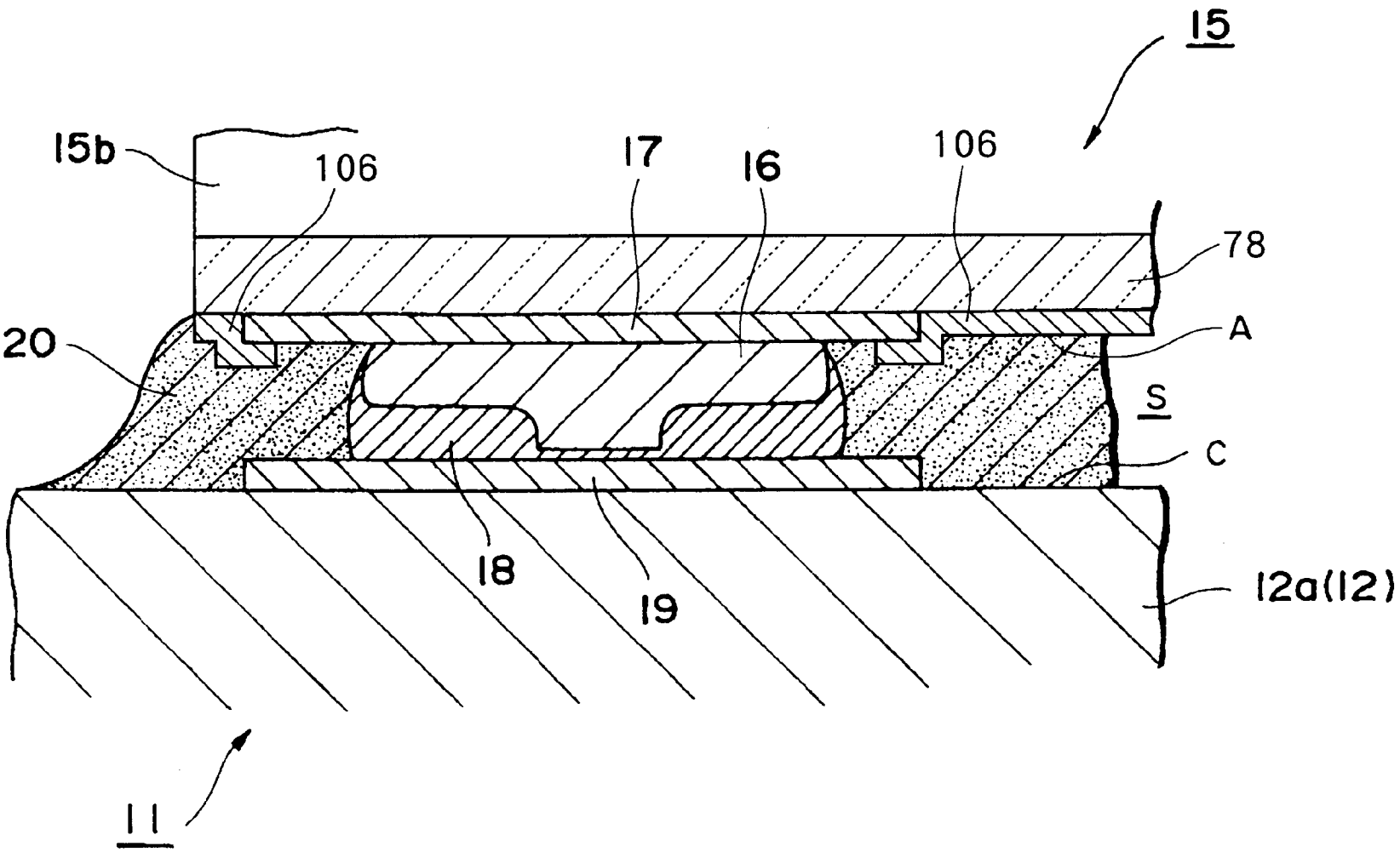
FIG. 7 is an enlarged cross-sectional view of an essential portion of FIG. 2, showing how a bump on the semiconductor device is bonded to a bump connection portion on the stem in the electron tube of the first embodiment.

The SiN film 106 is mainly made of SiN. As shown in FIG. 4, the SiN film 106 is formed over the entire front surface A on top of the PSG layer 78 and the aluminum wires 86. As shown in FIG. 7, the SiN layer 106 are partly removed at positions that correspond to the bonding pads 17 to expose the bonding pads 17 and the bumps 16. In this way, the exposed bumps 16 form electrodes for maintaining electrical connection with the bump connection portions 19 on the base plate 12*a*.

With this construction, a plurality of aluminum wiring end portions (pads) 17 are formed on the front surface A in two opposing rows on the periphery part 15*b* of the semiconductor device 15, as shown in FIG. 3. As shown in FIG. 7, the bump 16 having Au (gold) as its main or primary component protrudes from each bonding pad 17. This type of metal bump 16 does not melt even when it is applied with heat of approximately 300° C. during the baking (heating) process in the electron tube manufacturing process.

As shown in FIG. 7, a plurality of Au (gold) bump connection portions 19 are formed on the surface C of the base plate 12*a* in the stem 11. The plurality of Au (gold) bump connection portions 19 serve as part of the wirings to the stem pins 14. The semiconductor device 15 is positioned facing the base plate 12*a* such that each bump 16 opposes the corresponding bump connection portion 19. A conductive resin 18 (such as a polymer adhesive) of paste form is applied around each bump 16. This conductive resin 18 alleviates stress deformation which is caused by difference in thermal expansion coefficients that results from the difference in material of the semiconductor device 15 and of the stem 11, thereby preventing breaks or disconnections of the bump 16 during the baking process. With this construction, the bump 16 is electrically and mechanically connected with the bump connection portion 19 via the conductive resin 18.

By fixing the bumps 16 to the bump connection portions 19 as described above, a space or gap S approximately corresponding to the height of the bumps 16 is formed between the front surface A of the semiconductor device 15 and the surface C of the base plate 12 as shown in FIG. 7. This space S is filled, at the periphery part 15*b* of the semiconductor device 15, with the insulating resin 20, such as a polymer adhesive, in the paste form. The insulating resin 20 is an adhesive agent used in microelectronics and has an adhesive tolerance of 400° C. or lower. After the space S in the periphery part 15*b* is filled with the insulating resin 20, the insulating resin 20 is cured or hardened. The insulating resin 20 functions as a reinforcing member when the electron tube 1 is assembled in a high-temperature environment (approximately 300° C.). The insulating resin 20 firmly fixes the.semiconductor device 15 to the stem 11, preventing the bumps 16 from separating from the bump connection portions 19. Since the insulating resin 20 does not enter the electron incidence part 15*a*, the electron incidence part 15*a* is not deformed or damaged by stress which is generated when the insulating resin 20 is cured.

Figure 8:
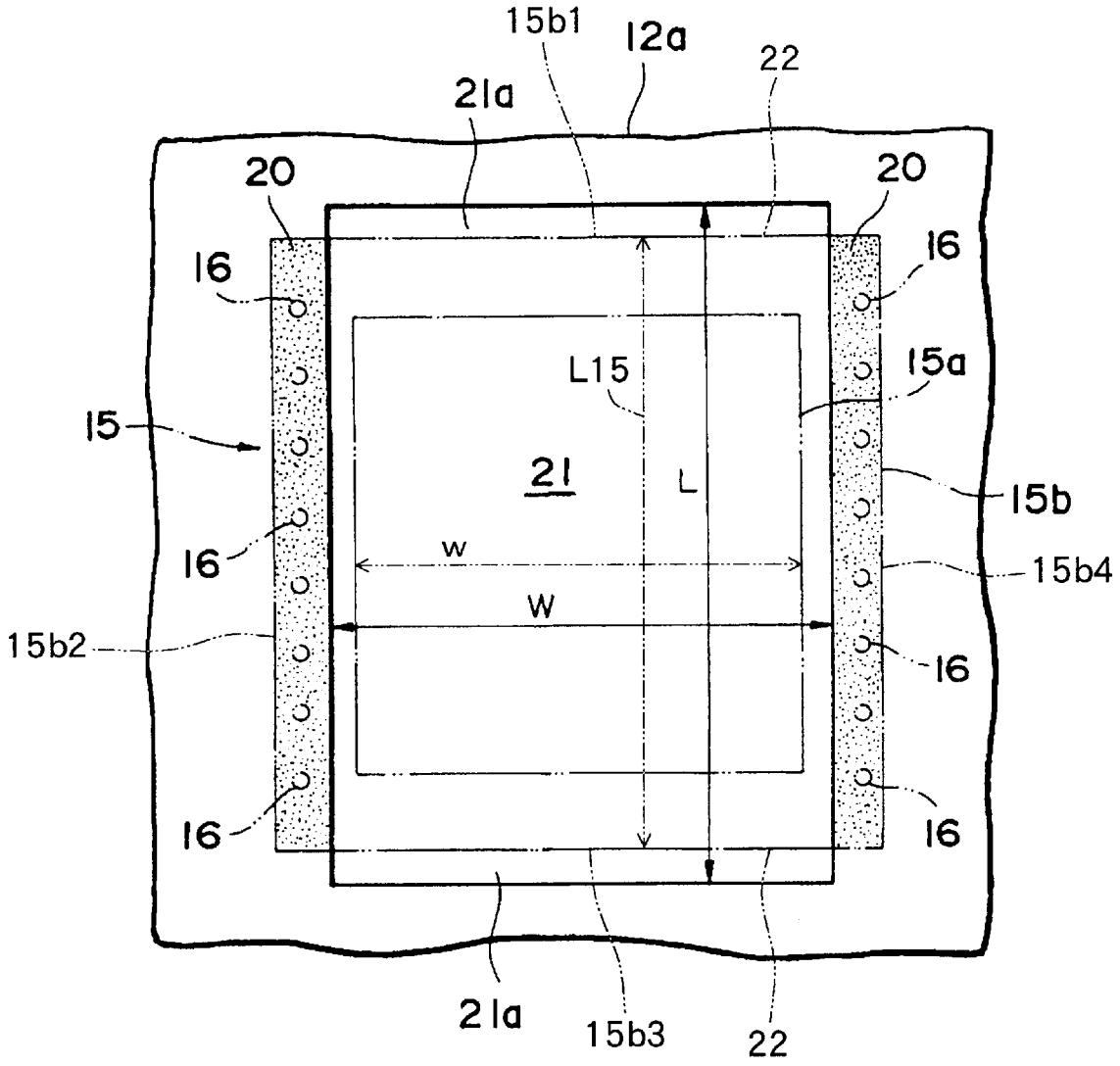
FIG. 8 is a plan view of a bonded portion of the semiconductor device, showing a channel provided on the electron tube of the first embodiment.

FIG. 8 shows the portion where the semiconductor device 15 is bonded to the base plate 12*a* in the manner described above. The plurality of bumps 16, which are mainly made of gold, are formed on the front surface A in two opposing rows at the rectangular periphery part 15*b* of the semiconductor device 15. The insulating resin 20 is provided to each row of bumps 16. More specifically, each of the opposing two side portions 15*b*2 and 15*b*4, in the four side portions 15*b*1, 15*b*2, 15*b*3, and 15*b*4 of the periphery part 15*b*, encloses the corresponding row of bumps 16. The insulating resin 20 is filled in the space S of the periphery part 15*b* at a position around each bump 16 in each of the side portions 15*b*2 and 15*b*4. The insulating resin 20 is not provided on the other side portions 15*b*1 and 15*b*3, which contain no bumps 16. As a result, the space S is partially closed by the insulating resin 20 without closing the entire circumference of the periphery part 15*b*.

By partially closing the space S with the insulating resin 20 in this way, a ventilating region 22 not filled with insulating resin 20 is formed in the space S along the circumference of the periphery part 15*b*, allowing the passage of air between the semiconductor device 15 and the stem 11. More specifically, the ventilating region 22 is formed on the two side portions 15*b*1 and 15*b*3 that have no bumps 16. Accordingly, the space S between the electron incidence part 15*a* of the semiconductor device 15 and the stem 11 is in fluid communication with the vacuum region R inside the electron tube 1.

If the entire circumference of the periphery part 15*b* were filled in completely by the insulating resin 20, an air reservoir would be formed between the electron incidence part 15*a* disposed in the center of the semiconductor device 15 and the surface C of the base plate 12. Since the air in this air reservoir would expand when the stem 11 is placed in a vacuum during the assembly process, there is a risk that the thin electron incidence part 15*a* may become damaged. Therefore, the construction of the present embodiment enables air to pass between the semiconductor device 15 and the stem 11, allowing air to be evacuated from this region when the electron tube 1 is assembled in a transfer device. Further, evacuation can be conducted smoothly because two ventilating regions 22 are formed opposite each other on either side of the space S formed between the electron incidence part 15*a* and the stem 11.

As shown in FIGS. 1, 2, and 8, a rectangular channel or groove 21 is formed on the surface C of the base plate 12*a* opposing the electron incidence part 15*a*. The channel 21 functions to control filling of the insulating resin 20. The channel 21 is formed to have: a width W that spans across one side portion (side portion 15*b*2 that contains a row of bumps 16) of the periphery part 15*b* and the opposing side portion (side portion 15*b*4 that contains the other row of bumps 16) of the periphery part 15*b*, and a length L that extends beyond the outer edges of both of the other opposing side portions (side portions 15*b*1 and 15*b*3 that contain no rows of bumps 16) of the periphery part 15*b*. Here, the width W of the channel 21 is greater than a width w of the electron incidence part 15*a* (W>w), while the length L of the channel 21 is longer than the length L15 of the semiconductor device 15 (L>L15). The rectangular channel 21 therefore surrounds the entire region of the electron incidence part 15*a*. While the insulating resin 20 is supplied from outside the periphery part 15*b* to fill the space S between the periphery part 15*b* and the base plate 12, any excess insulating resin 20 can flow into the rectangular channel 21 that has the structure described above, thereby reliably avoiding the insulating resin 20 from becoming attached to the electron incidence part 15*a*. Therefore, the filling of the insulating resin 20 can be appropriately attained, even when the setting of the amount of filler and the filling operation is not conducted with high precision.

By setting the height of the space S to about 50 $\mu$m, an extremely narrow dimension, the insulating resin 20 will flow into the space S due to its capillary effect. In this way, it becomes easy and efficient to draw the insulating resin 20 into the space S. In this case, it is desirable to set the depth of the rectangular channel 21 to about 0.5 mm in order to block or stop the insulating resin 20 that flows by the capillary effect. When the insulating resin 20 flowing through the space S by the capillary effect reaches the rectangular channel 21, the surface tension of the resin material causes the material to collect along the edge of the rectangular channel 21 rather than entering into the rectangular channel 21. Accordingly, the insulating resin 20 can be reliably prevented from being attached on the electron incidence part 15*a*. Hence, the process of filling the insulating resin 20 can be performed easily and appropriately.

The rectangular channel 21 also has a length L so that the rectangular channel 21 can extend beyond the outer edges of the opposing side portions, which have no bumps 16, of the periphery part 15*b*, thereby providing openings 21*a* in the rectangular channel 21. When assembling the electron tube 1 inside a transfer device, therefore, air in the rectangular channel 21 escapes not only in the lateral direction via the narrow space S, but also in the upward direction through the openings 21*a*, achieving superb airflow. By forming the rectangular channel 21 at a size large enough to encircle the electron incidence part 15*a*, it is possible to reliably prevent insulating resin 20 from becoming attached on the electron incidence part 15*a*.

Next, a brief description will be given for the assembly procedure of the electron tube 1.

First, a semiconductor device 15 having the construction shown in FIG. 3 is positioned on the base plate 12 of the stem 11. The bumps 16 and the bump connection portions 19 are pressed together with an interposed conductive resin 18, and are heated at about 150° C. The bumps 16 and the bump connection portions 19 are connected together when the solvent in the conductive resin 18 is volatilized.

Next, the space S between the periphery part 15*b* and the stem 11 is selectively filled with a paste-shaped insulating resin 20. When introducing the insulating resin 20 toward the bumps 16 from outside the periphery part 15*b*, the capillary effect draws the insulating resin 20 into the space S. At this time, the insulating resin 20 is blocked by the rectangular channel 21 and does not become attached on the electron incidence part 15*a*. If the space between the electron incidence part 15*a* and the base plate 12 were filled with insulating resin 20, the stress generated when the insulating resin 20 hardens would deform the electron incidence part 15*a*, making it impossible to achieve qualitty images with the semiconductor device 15. The present embodiment avoids this problem by reliably preventing the insulating resin 20 from becoming attached on the electron incidence part 15*a*. After fixing the semiconductor device 15 to the stem 11 in this way, the side tube 2 and the stem 11 are integrated into one piece by arc-welding the metal flange 13 of the stem 11 to the welding electrode 6 of the side tube 2.

As described above, according to the electron tube 1 of the present invention, there is no need to thin the semiconductor device by etching or the like after the semiconductor device 15 is fixed to the stem 11. It is sufficient to merely fix the completed semiconductor device 15 to the stem 11. The semiconductor device 15, the stem 11, and the like needed to manufacture the electron tube 1 may be mass-produced in advance. The electron tube 1 is then assembled by fixing these parts according to the above-described method, thereby facilitating mass-production of the electron tube 1.

Subsequently, the side tube 2 fixed with the stem 11, and the faceplate 8, onto which the photocathode electrode 10 of a chrome thin film is deposited, are introduced into the transfer device. The inside of the transfer device is brought into a vacuum state. The components are assembled together into the electron tube 1 in the vacuum state inside the transfer device. At this time, the space S between the semiconductor device 15 and the stem 11 is only partially closed by the insulating resin 20, preserving ventilation therebetween. That is, the space S between the semiconductor device 15 and the stem 11 is in fluid communication with the inside of the transfer device via the ventilating regions 22 and the openings 21*a*. Therefore, when evacuating the transfer device, air in the space S is properly discharged without forming an air reservoir between the electron incidence part 15*a* and the surface C of the base plate 12.

Next, the inside of the transfer device is heated (baked) to approximately 300° C., and the photocathode 9 composed mainly of K, Cs, and Na is formed on the faceplate 8. Even if gas is emitted during this baking process from the insulating resin 20 into the space S between the semiconductor device 15 and stem 11, such gas is not trapped inside the space S, but is discharged via the ventilating regions 22 and the openings 21*a*.

Subsequently, the faceplate 8 is fixed and sealed to the cathode electrode 5 via the indium material 4. As a result, the stem 11, the side tube 2, and the faceplate 8 form the vacuum region R inside the electron tube 1. Next, the getter G is activated by supplying electricity through the welding electrode 6 and the flange portion 7. As a result, the getter G absorbs residual gas in the electron tube 1. If gas remains in the space S between the semiconductor device 15 and the stem 11, this gas is not trapped in the space S, but is discharged into the vacuum region R via the ventilating regions 22 and the openings 21*a*, enabling the getter G to absorb the gas reliably. Lastly, by removing the electron tube 1 from the transfer device, the procedure for assembling an electron tube 1, whose inside is in the vacuum state, is completed.

Next, the operations of the electron tube 1, produced as described above, will be described briefly.

A voltage of −8 kV is applied to the photocathode 9. An electron incidence surface 15A (see FIGS. 2 and 4) of the electron incidence part 15*a*, which is positioned on the back surface B of the semiconductor device 15, is set to a ground potential. Electrons are emitted from the photocathode 9 when light from outside falls incident on the photocathode 9. The electrons are accelerated by the electric field in the electron tube 1 and are bombarded into the electron incidence surface 15A. Numerous electron-hole pairs are formed when the accelerated electrons lose energy in the silicon substrate of the semiconductor device 15, yielding a gain of approximately 2,000 times at −8 kV. A high quality image can be obtained on a monitor by electrically outputting these multiplied electrons from the semiconductor device 15 via the stem pins 14 to the outside monitor.

Since the electron tube 1 of the present embodiment can achieve a high gain, as described above, the signal level of the image is sufficiently higher than the noise component of the CCD element 15. Such a high S/N ratio makes it possible to perform single photon imaging. Compared to conventional electron tubes with a built-in microchannel plate (MCP), the electron tube 1 of the present embodiment improves the open area ratio determining efficiency, reduces irregularity in the fluorescent screen, and prevents conversion loss in a fiber-coupled fiber optical plate (FOP).

It is noted that when producing normal electron tubes, alkali metals such as Na, K, and Cs are introduced into the electron tubes in order to form the photocathode. There is a risk that the alkali metals will possibly enter the charge transfer section of the semiconductor device 15. If the alkali metals reach the $SiO_2$ gate film, the alkali metals increase the fixed charges and the interface state of that portion, remarkably degrading the properties of the semiconductor device 15. However, the electron tube 1 of the present embodiment prevents alkali metals, introduced into the tube, from entering the device by forming the SiN layer 106 on the entire part of the top surface of the semiconductor device 15. Accordingly, the properties of the semiconductor device 15 are not degraded by preventing alkali metal from reaching the $SiO_2$ layer 70, thereby achieving a highly sensitive electron tube.

In the electron tube 1 of the first embodiment described above, the space S formed between the periphery part 15*b* and the stem 11 is partially filled with insulating resin 20. Therefore, the insulating resin 20 functions as a reinforcing member to prevent the bumps 16 from separating from the bump connection portions 19 even when the electron tube 1 is assembled in a high-temperature environment. Further, since the insulating resin 20 is not introduced in the electron incidence part 15*a*, the electron incidence part 15*a* is not deformed or damaged due to stress generated when the insulating resin 20 is hardened.

Ventilation is maintained between the semiconductor device 15 and the stem 11 since the insulating resin 20 only partially closes the space between the periphery part 15*b* and the stem 11. Accordingly, an air reservoir is not formed between the electron incidence part 15*a* positioned at the center of the semiconductor device 15 and the surface C of the stem 11, thereby avoiding damage to the electron incidence part 15*a* that can be caused by air expanding under high temperatures. In addition, if gas is emitted from the resin during the high-temperature process to form the photocathode 9, such gas does not become trapped or expand in the space between the semiconductor device 15 and the stem 11, thereby avoiding damage to the electron incidence part 15*a*.

Next, an electron tube according to a second embodiment of the present invention will be described with reference to FIGS. 9–11.

Figure 9:
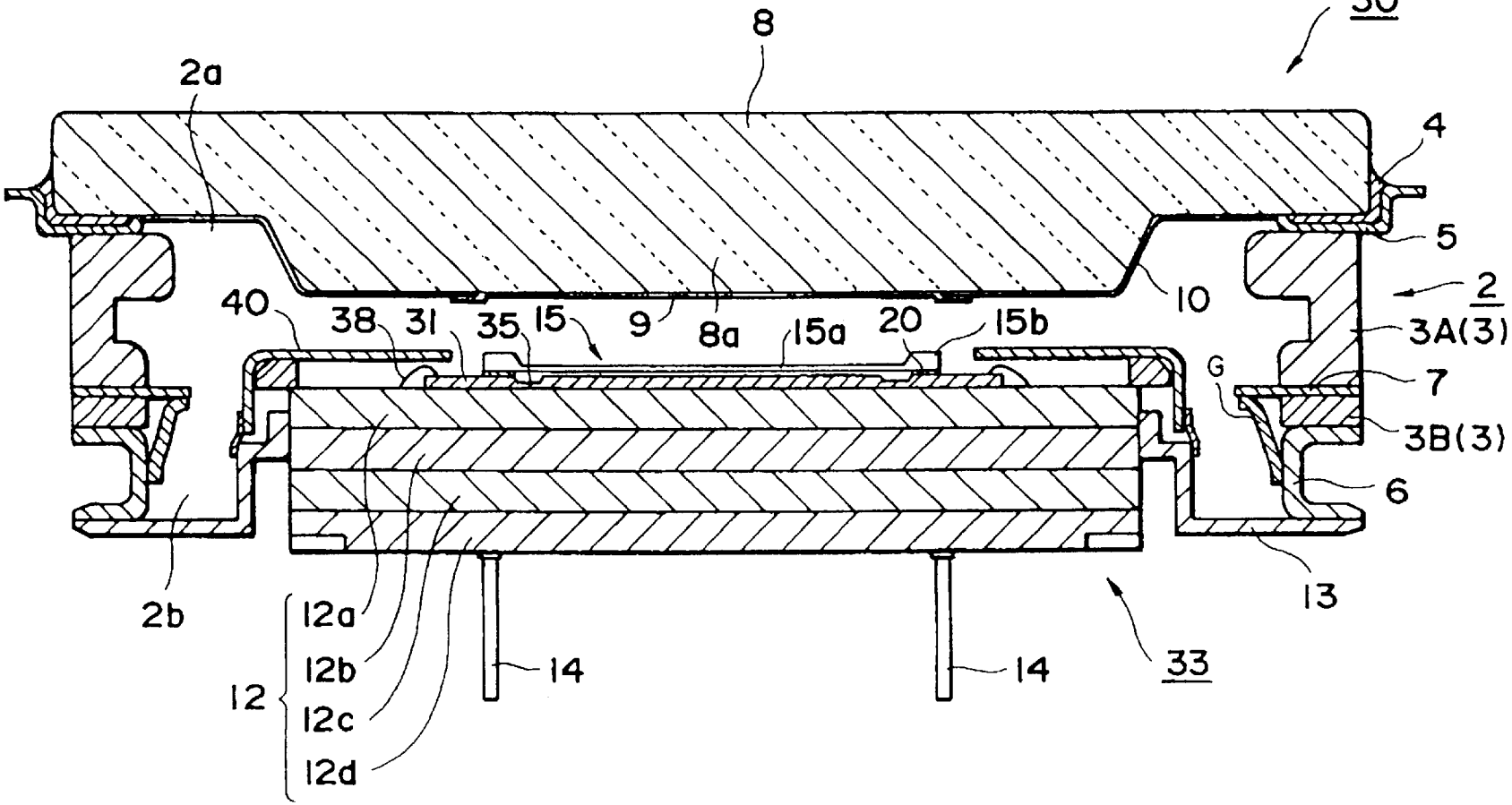
FIG. 9 is a cross-sectional view showing an electron tube according to a second embodiment.
Figure 10:
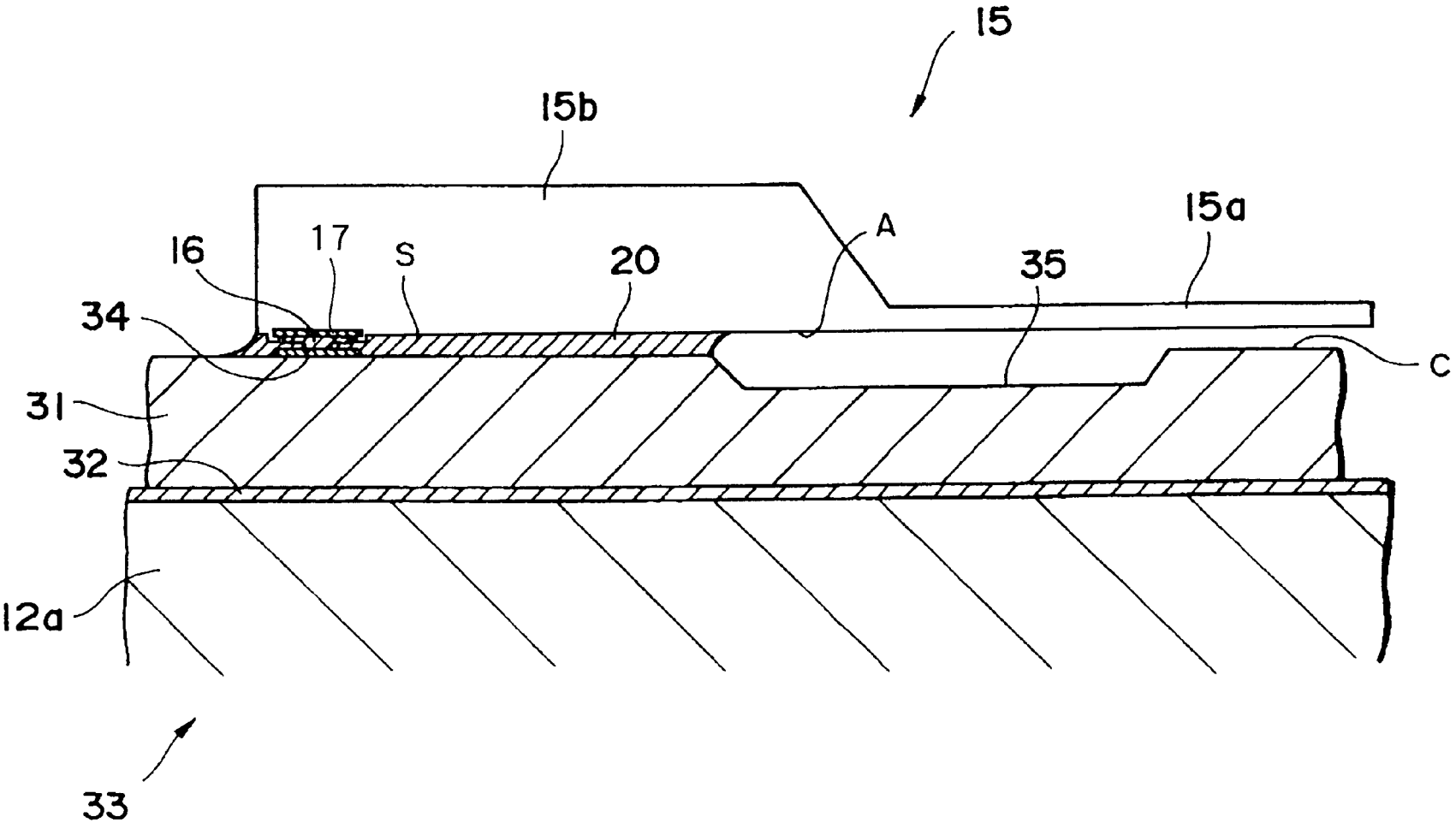
FIG. 10 is an enlarged cross-sectional view showing the portion where the semiconductor device is bonded to a supporting substrate of the electron tube according to the second embodiment.

FIG. 9 is a cross-sectional view of an electron tube 30 according to the second embodiment. The electron tube 30 is a proximity focusing type electron tube with a photocathode being positioned near to a semiconductor device. Like parts and components with the electron tube 1 of the first embodiment are given the same reference numerals to avoid duplicate description.

Next, the differences between the electron tube 30 of the second embodiment and the electron tube 1 of the first embodiment will be described with reference to FIGS. 9 and 10.

A supporting substrate 31 is fixed to the top surface of the base plate 12*a* by an adhesive 32. The supporting substrate 31 is composed of silicon material which is the same as the base material (silicon substrate) of the semiconductor device 15. The supporting substrate 31 forms a portion of a stem 33. A plurality of bump connection portions 34 are arranged in two opposing rows on the surface C of the supporting substrate 31 in the stem 33. The bump connection portions 34 are formed by depositing Au. A plurality of bumps 16 are formed in two opposing rows on the front surface A of the semiconductor device 15, in the same manner as in the first embodiment. Each bump 16 is connected to a corresponding bump connection portion 34. Since the supporting substrate 31 is formed of the same silicon material as the semiconductor device 15, the thermal expansion coefficients of the two components are equal to each other. Therefore, stress deformation caused by heat during the baking step of the manufacturing process does not occur, preventing disconnection of the bumps 16. As a result, it is possible to satisfactorily maintain the connection between the bumps 16 and the bump connection portions 34 even without applying the conductive resin 18 to the bumps 16.

Even with this construction, however, the :bonding strength of the gold bumps 16 decreases as the temperature rises, making it necessary to reinforce the bumps 16 with the insulating resin 20. Therefore, as shown in FIGS. 10 and 11, the space S at the side portions 15*b*2 and 15*b*4 in the periphery part 15*b* is filled with insulating resin 20 so that the insulating resin 20 will encompass each bump 16 in the same manner as in the first embodiment. Also, the side portions 15*b*1 and 15*b*3 that have no bumps 16 are not filled with the insulating resin 20. Hence, this construction forms the ventilating regions 22, enabling the space S between the electron incidence part 15*a* and the stem 33 to be in fluid communication with the vacuum region R in the electron tube 1.

A channel or groove 35 is formed on the surface C of the supporting substrate 31 in correspondence with each row of bumps 16. Similarly to the channel 21 of the first embodiment, the channel 35 is provided to control the filling of the insulating resin 20. Here, each channel 35 has a width W1 that spans across the border between the corresponding periphery part 15*b* and the electron incidence part 15*a*, and a length L1 that corresponds to the row of bumps 16. Hence, each channel 35 surrounds the border portion 150 between the corresponding side portion 15*b*2 or 15*b*4 of the periphery part 15*b* and the electron incidence part 15*a*. The channels 35 are formed by a chemical etching process using KOH solution. The channels 35 thus formed on the surface C of the supporting substrate 31 provide an outlet into which excess insulating resin 20 can flow, preventing insulating resin 20 from becoming attached on the electron incidence part 15*a*. Therefore, the space S can be appropriately filled, even when the setting of the amount of insulating resin 20 and the filling operation is not conducted with high precision.

By setting the height of the space S to about 50 μm, an extremely narrow dimension, the insulating resin 20 can be drawn into the space S by the capillary effect. In this way, it is easy and efficient to cause insulating resin 20 to flow into the space S. In this case, it is desirable to set the depth of the channel 35 to about 0.1 mm in order to block the insulating resin 20 that flows by the capillary effect. With this construction, when the insulating resin 20 drawn through the space S by the capillary effect reaches the channel 35, the insulating resin 20 collects along the edge of the channel 35 due to surface tension, rather than entering the channel 35. Accordingly, the insulating resin 20 can be easily and reliably prevented from attaching the electron incidence part 15*a*. Hence, the process of filling the insulating resin 20 can be performed easily and appropriately.

Figure 11:
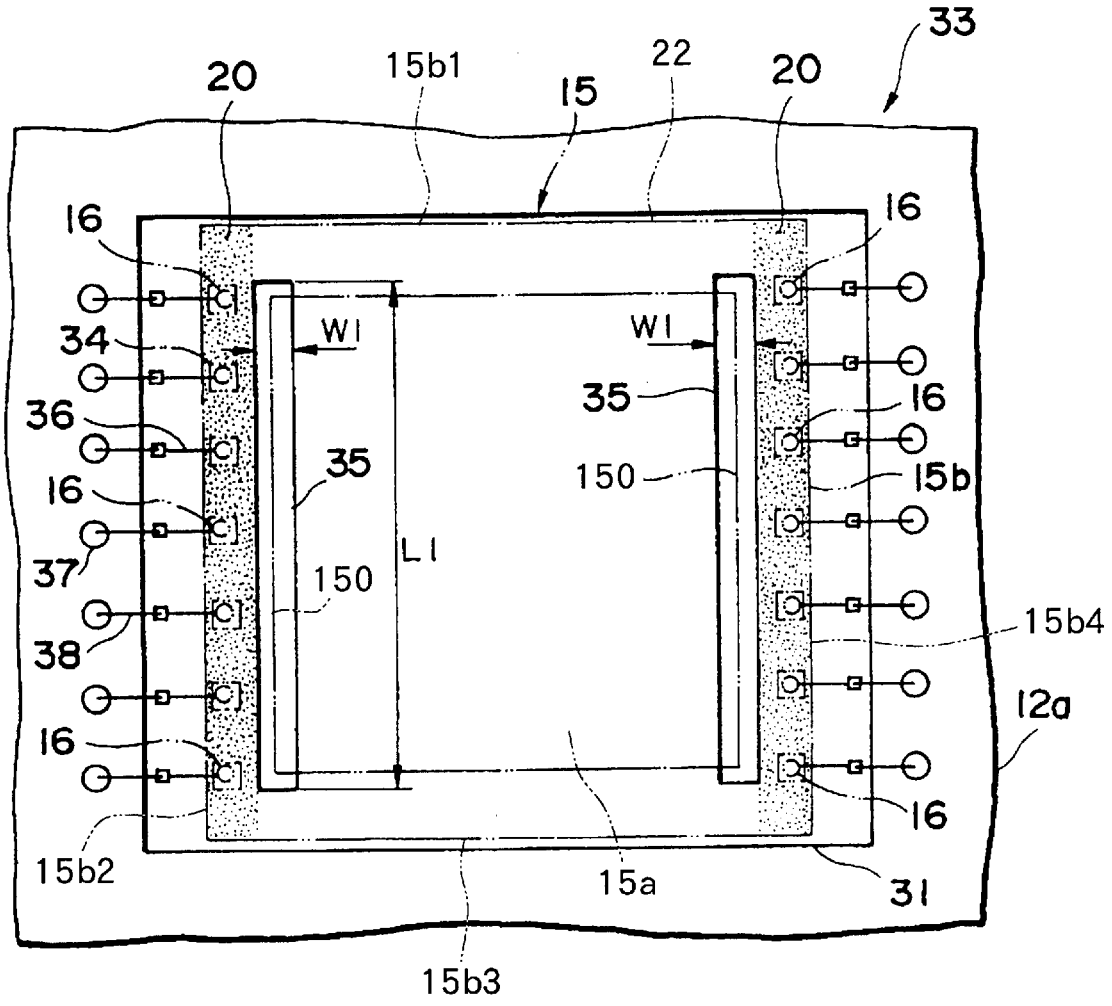
FIG. 11 is a plan view showing the portion where the semiconductor device is bonded to the supporting substrate with a channel according to the second embodiment.

As shown in FIG. 11, aluminum (Al) wirings 36 are provided on the supporting substrate 31 to extend laterally from the respective bump connection portions 34. Stem terminals 37 are provided on the base plate 12*a* in correspondence with the respective aluminum wirings 36. The stem terminals 37 are electrically connected to the respective stem pins 14. Further, the terminal of each aluminum wiring 36 is wire-bonded to the corresponding stem terminal 37 by an aluminum wire 38.

As shown in FIG. 9, shield electrodes 40 are provided to cover the aluminum wires 38. The base end of each shield electrode 40 is resistance welded to the metal flange 13 to increase a withstand voltage between the photocathode 9 and the semiconductor device 15. By covering the aluminum wires 38 with the shield electrodes 40, it is possible to bring the photocathode 9 in close to the semiconductor device 15. This allows the accelerating voltage to be increased, improving the resolution of images that can be obtained by the semiconductor device 15, and further improving the gain of the semiconductor device 15.

Next, an electron tube according to a third embodiment of the present invention will be described with reference to FIG. 12.

Figure 12:
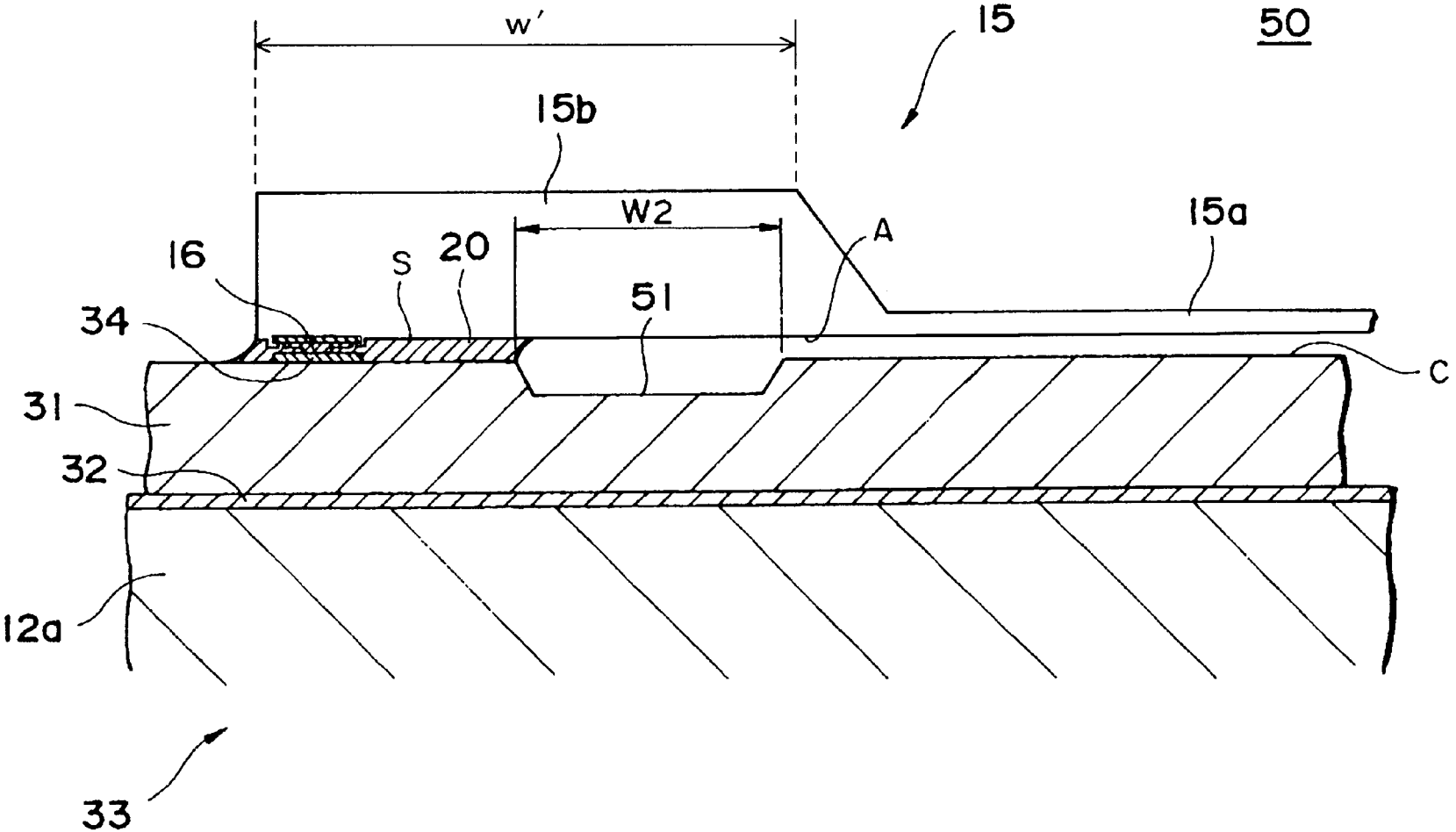
FIG. 12 is an enlarged cross-sectional view showing an essential portion of an electron tube according to a third embodiment.

FIG. 12 is a cross-sectional view showing an electron tube 50 according to the third embodiment. Parts and components similar to those of the electron tube 30 in the second embodiment are given the same reference numerals to avoid duplicate description.

The differences between the electron tube 50 of the third embodiment and the electron tube 30 of the second embodiment will be described with reference to FIG. 12.

In correspondence with each row of bumps 16, a channel or groove 51 is formed on the surface C of the supporting substrate 31 which forms a portion of the stem 33.

Similarly to the channel 21 of the first embodiment and the channel 35 of the second embodiment, the channel 51 facilitates the operation for filling the insulating resin 20. In the present embodiment, the channel 51 is formed at a position opposing only the periphery part 15*b*. Each channel 51 has: a length L1 which corresponds to the corresponding row of bumps 16, and a width W2 which is smaller than the width w' of the periphery part 15*b* (W2<w'). By forming such a linear channel 51, any excess insulating resin 20 can flow into the channel 51, thereby reliably preventing insulating resin 20 from becoming attached on the electron incidence part 15*a*. Therefore, the space S can be appropriately filled with the insulating resin 20 through simple control of the resin amount.

By setting the height of the space S to about 50 μm, an extremely narrow dimension, the insulating resin 20 can be drawn into the space S by the capillary effect. In this way, the insulating resin 20 can be efficiently introduced into the space S. If the depth of the channel 35 is set to about 0.1 mm in order to block the insulating resin 20 that flows by the capillary effect, the flow of the insulating resin 20 can be controlled more efficiently and more reliably.

The electron tube according to the present invention is not limited to the above-described embodiments, but many modifications and variations may be made thereto.

For example, in the above embodiments, the channel 21, the channel 35, or the channel 51 is formed in the.uppermost base plate 12*a* or the supporting substrate 31. However, it is not necessary to form such a channel as shown in an example of FIG. 13. Even without a channel, it is possible to introduce the insulating resin 20 appropriately while preventing the insulating resin 20 from contacting the electron incidence part 15*a*, by controlling the amount of insulating resin 20 and the filling operation with precision.

Further, a ventilating region 22 may be formed in at least one portion of the periphery part 15*b* by leaving at least one portion of the space S on the entire circumference of the periphery part 15*b* unfilled. In other words, it is only necessary to form at least one ventilating region 22. One ventilating region 22 is sufficient to achieve fluid communication between the space S, formed between the semiconductor device 15 and stem 11 or stem 33, and the vacuum region R. However, smoother ventilation can be achieved by forming a plurality of ventilating regions 22 in the space S as described in the above embodiments, and particularly by forming the ventilating regions 22 so that they oppose with one another with the space S between the electron incident part 15*a* and the stem 11 or 33 being sandwiched between the opposing ventilating regions 22.

In the embodiments described above, the insulating resin 20 is filled in the space S of the periphery part 15*b* at positions around the bumps 16. However, the insulating resin 20 may be filled at portions not around the bumps 16. Even when insulating resin 20 is applied at positions not surrounding the bumps 16, it is possible to adhesively fix the semiconductor device 15 to the stem 11 or stem 33, thereby reinforcing the bumps 16 indirectly by maintaining the space S.

Figure 13:
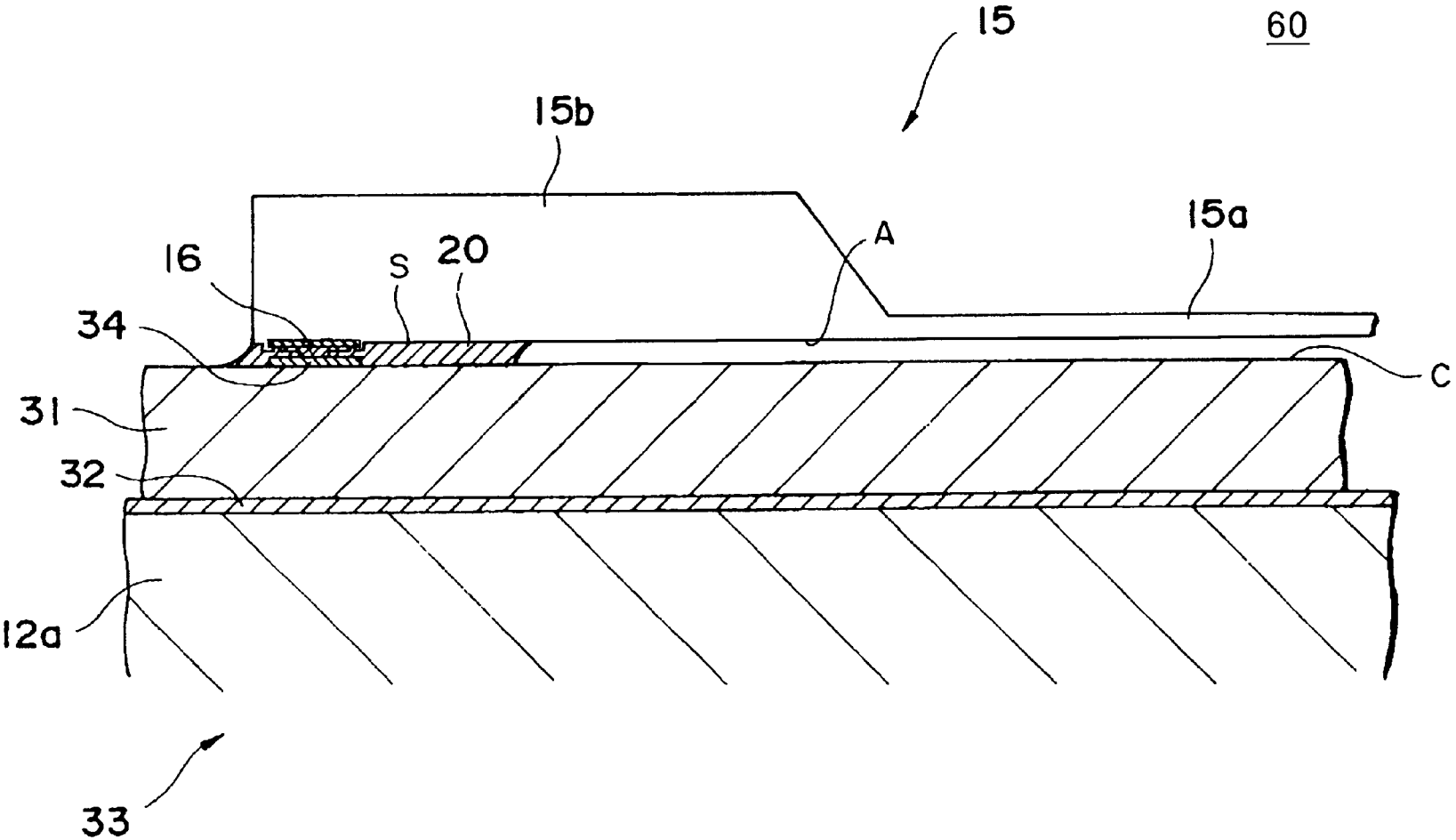
FIG. 13 is an enlarged cross-sectional view showing the portion where the semiconductor device is bonded to the supporting substrate of the electron tube according to a modification of the embodiments.
Figure 14:
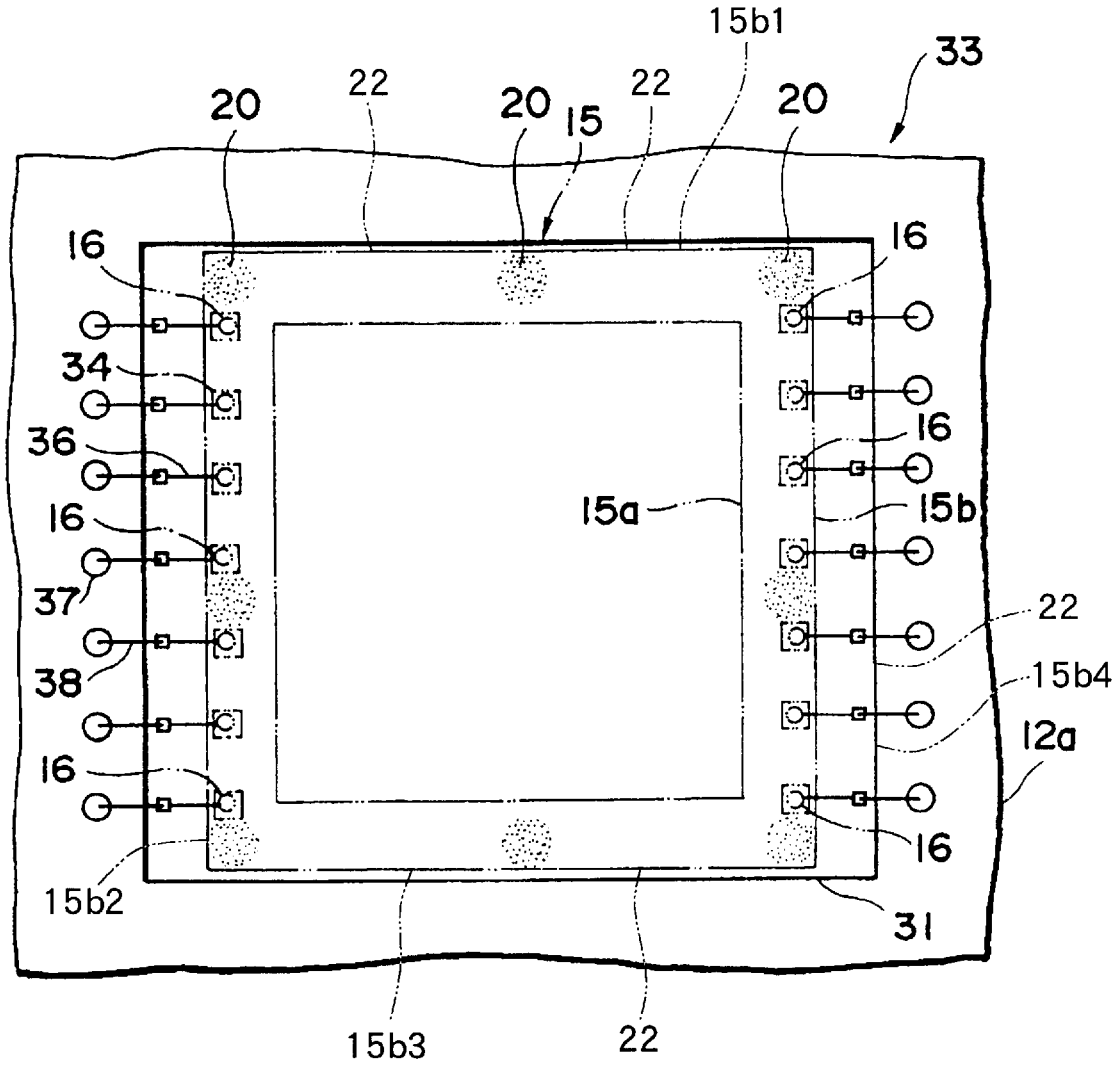
FIG. 14 is a plan view showing the portion where the semiconductor device is bonded to the supporting substrate according to a modification of the electron tube of the embodiments.

For example, the space S can be filled with insulating resin 20 only at positions corresponding to the four corners of the periphery part 15*b*. Or, as shown in FIG. 14, the space S may be filled with insulating resin 20 only at positions corresponding to the four corners of the periphery part 15*b* and positions corresponding to the approximate center of the four side portions 15*b*1–15*b*4. Also in this case, it is not necessary to form channels similarly to as shown in FIG. 13.

Further, while an insulating resin is used in the above embodiments as the filling material, any filling material with insulating properties can be used. In other words, any material that is normally in a solution state or a paste-state and that has insulating properties can be used, if it cures or hardens under heat, if it shrinks according to an appropriate contraction stress during curing, and if it adheres to surrounding components when contracting. By adhering to both of the semiconductor device 15 and the stem 11 or stem 33 and contracting, the filler material can adhesively fix both of the semiconductor device 15 and the stem 11 or 33 and can achieve reliable contact and good electrical connection between the bumps 16 and the bump connection portions 19. Examples of such material include water glass and low-melting glass.

Although a SiN film 106 is formed on the semiconductor device 15 in the embodiments described above, this layer is not necessary.

The electron tube of the present invention is not limited to a proximity focusing type electron tube, but can also be an electrostatically-focusing type electron tube.

Industrial Applicabillty

The electron tube according to the present invention can be used in a wide range of imaging devices designed for low light intensity region, such as surveillance cameras and night vision cameras.

What is claimed is:

1. An electron tube, comprising:

a side tube;

a faceplate provided at one end of the side tube and having a photocathode that emits electrons in response to incident light;

a stem provided at the other end of the side tube, the stem and the faceplate defining a vacuum region, the stem having a bump connection portion on its surface; and a semiconductor device fixed to the stem at its vacuum side, the semiconductor device having a front surface positioned on the stem side and a back surface positioned of the faceplate side, the semiconductor device including an electron incidence part, for receiving electrons emitted from the photocathode, and a periphery part provided at an outer periphery of the electron incidence part, the electron incidence part having a thin plate shape whose thickness is smaller than that of the periphery part, the periphery part having a bump which protrudes from the front surface thereof, the bump being fixed to the bump connection portion, the bump forming a space between the front surface of the semiconductor device and the surface of the stem, a filling material with insulation property being filled partially in the space at the periphery part, thereby partially closing the space at the periphery part.

2. An electron tube as claimed in claim 1, wherein the filling material with insulation property is filled in the space at the periphery part of the semiconductor device except for at least one position along the entire circumference of the periphery part, thereby allowing the space at the periphery part to be filled with the filling material with insulation property except for the at least one position.

3. An electron tube as claimed in claim 2, wherein the filling material with insulation property is filled in the space at at least one position along the entire circumference of the periphery part of the semiconductor device, with a ventilating region being formed in at least one position along the entire circumference of the periphery part of the semiconductor device to provide fluid communication between the space and the vacuum region.

4. An electron tube as claimed in claim 1, wherein the filling material with insulating property includes insulating resin.

5. An electron tube as claimed in claim 1, wherein the stem has a supporting substrate on its surface, the supporting substrate being formed of the same silicon material as a base material of the semiconductor device, the bump connection portion being provided on the supporting substrate.

6. An electron tube as claimed in claim 1, wherein the bump is made of material that includes gold as a primary component.

7. An electron tube as claimed in claim 1, wherein the stem has, at its surface, a channel for controlling the partial filling of the filling material with insulating property into the space at the periphery part.

8. An electron tube as claimed in claim 7, wherein the channel has a width that allows the channel to span across a border between the periphery part and the electron incidence part.

9. An electron tube as claimed in claim 7, wherein the channel is formed at a region that faces the periphery part only.

10. An electron tube as claimed in claim 7, wherein the channel has a width that allows the channel to span across one side portion of the periphery part and the other opposing side portion of the periphery part.

11. An electron tube as claimed in claim 7, wherein the space formed by the bump has, at the periphery part, a height small enough to allow the filling material with insulation property to generate a capillary effect when the filling material is drawn into the periphery part, the channel having a depth of an amount that is capable of stopping the filling material that flows due to the capillary effect.

* * * * *